US009963956B2

(12) United States Patent
Vilstrup et al.

(10) Patent No.: US 9,963,956 B2
(45) Date of Patent: May 8, 2018

(54) MODULAR MOBILE FLOW METER SYSTEM

(71) Applicant: Schlumberger Technology Corporation, Sugar Land, TX (US)

(72) Inventors: Alexander Tuborg Vilstrup, Singapore (SG); Muhammad Fuad Bin Mohamed Zain, Singapore (SG); Guillaume Jolivet, Singapore (SG); Jean-Philippe Hussenet, Moscow (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 155 days.

(21) Appl. No.: 14/793,404

(22) Filed: Jul. 7, 2015

(65) Prior Publication Data

US 2017/0010139 A1 Jan. 12, 2017

(51) Int. Cl.
*G01F 1/74* (2006.01)
*E21B 43/12* (2006.01)

(52) U.S. Cl.
CPC ..... *E21B 43/12* (2013.01)

(58) Field of Classification Search
CPC . E21B 43/12; E21B 47/10; G01F 1/74; G01F 1/00; G01F 1/50; G01F 1/90; G01N 1/21035
USPC ..... 73/861, 861.04, 861.01, 861.02, 861.03
See application file for complete search history.

(56) References Cited

U.S. PATENT DOCUMENTS 5,741,977 A 4/1998 Agar et al.
7,654,151 B2 2/2010 Agar et al.
7,661,302 B2 2/2010 Gysling
7,717,000 B2 5/2010 Xie et al.
7,908,930 B2 3/2011 Xie et al.
7,942,065 B2 5/2011 Xie et al.
8,536,883 B2 9/2013 Xie et al.
8,606,531 B2 12/2013 Pinguet et al.
8,641,813 B2 2/2014 Gysling
2009/0000389 A1 1/2009 Redon
(Continued)

FOREIGN PATENT DOCUMENTS

CN 201405330 2/2010
CN 201405330 Y 2/2010
(Continued)

OTHER PUBLICATIONS

International Search Report and Written Opinion issued in the related PCT application PCT/US2016/041036 dated Nov. 1, 2016 (14 pages).

(Continued)

*Primary Examiner* — Harshad R Patel
*Assistant Examiner* — Nigel Plumb
(74) *Attorney, Agent, or Firm* — Cameron R. Sneddon

(57) ABSTRACT

A technique facilitates evaluation of a fluid, such as a fluid produced from a well. The technique utilizes a modular and mobile system for testing flows of fluid which may comprise mixtures of constituents. A modular flow meter system comprises a plurality of modules which each have a multiphase flow meter coupled into a flow circuit. The flow circuits of the plurality of modules are selectively connectable to each other via flow connectors. Additionally, portions of the flow circuits may be selectively opened and closed to enable controlled routing of the fluid being tested through the desired multiphase flow meter or meters.

20 Claims, 8 Drawing Sheets

(56) References Cited

U.S. PATENT DOCUMENTS

| | | | |
|---|---|---|---|
| 2010/0198531 | A1 | 8/2010 | Bell et al. |
| 2010/0305880 | A1 | 12/2010 | Oddie |
| 2012/0017697 | A1 | 1/2012 | Benzo et al. |
| 2012/0242081 | A1 | 9/2012 | Keays et al. |
| 2013/0206420 | A1 | 8/2013 | McHugh et al. |
| 2013/0327154 | A1 | 12/2013 | Xie et al. |
| 2014/0041463 | A1 | 2/2014 | Vethe et al. |
| 2014/0137643 | A1 | 5/2014 | Henry et al. |

FOREIGN PATENT DOCUMENTS

| | | | |
|---|---|---|---|
| CN | 203216545 | U | 9/2013 |
| DE | 9218091 | | 7/1993 |
| EP | 2171407 | A1 | 4/2010 |

OTHER PUBLICATIONS

International Search Report and Written Opinion issued in the related PCT application PCT/US2016/030165 dated Aug. 4, 2016 (13 pages).

MODULAR MOBILE FLOW METER SYSTEM

BACKGROUND

Field

The present disclosure relates to techniques for measuring multiphase flows from wellbores. More particularly, the present disclosure relates to tools and methods for a mobile multiphase flowmeter system.

Description of the Related Art

In many hydrocarbon well applications, various test procedures are employed to evaluate characteristics of the produced well fluid or other reservoir characteristics. Often, the produced well fluid contains a mixture of phases, such as a mixture of oil, water, gas, and solids or other components. Test procedures have been employed to evaluate the phases of produced fluids from specific wells. For example, various types of well testing equipment utilize multiphase flow meters to measure the various phases of the produced fluid. Multiphase flow meters, however, have different flow-range ratings and are selected according to the production flow rate of the well being tested. Thus, different multiphase flow meters with different flow-range ratings are selected according to the production flow rate of a given well. Switching the multiphase flow meter to accommodate the flow range of a different well can be an expensive and time-consuming procedure.

SUMMARY

In general, a methodology and system provide a modular and mobile system for testing flows of fluid which may comprise mixtures of constituents. A modular flow meter system comprises a plurality of modules which each have a multiphase flow meter coupled into a flow circuit. The flow circuits of the plurality of modules are selectively connectable to each other via flow connectors. Additionally, portions of the flow circuits may be selectively opened and closed to enable controlled routing of the fluid being tested through the desired multiphase flow meter or meters.

However, many modifications are possible without materially departing from the teachings of this disclosure. Accordingly, such modifications are intended to be included within the scope of this disclosure as defined in the claims.

BRIEF DESCRIPTION OF THE DRAWINGS

So that the manner in which the above recited features can be understood in detail, a more particular description may be had by reference to embodiments, some of which are illustrated in the appended drawings, wherein like reference numerals denote like elements. It is to be noted, however, that the appended drawings illustrate various embodiments and are therefore not to be considered limiting of its scope, and may admit to other equally effective embodiments.

DETAILED DESCRIPTION

Figure 1:
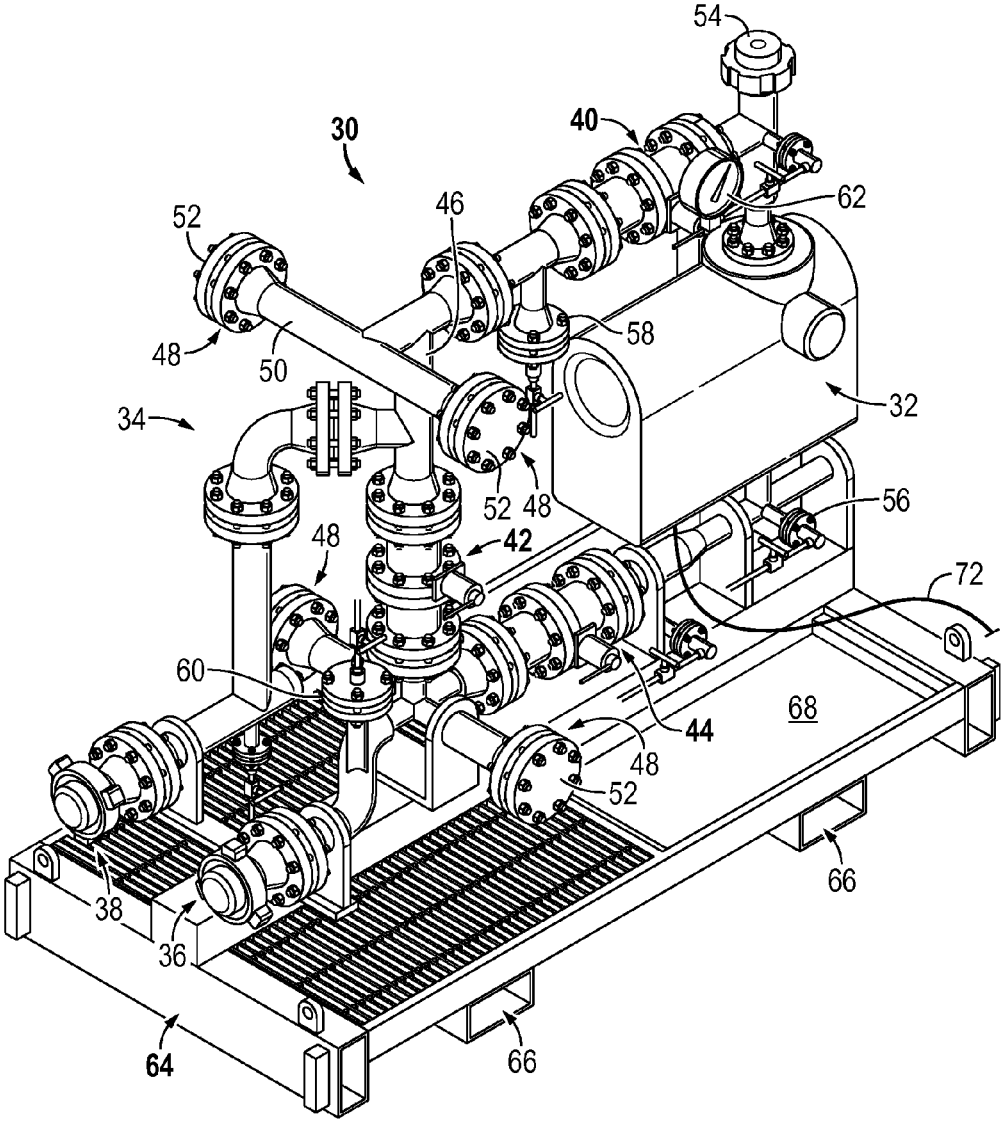
FIG. 1 is an illustration of an example of a flow test module which may be coupled into a modular flow meter system for evaluating flows of fluids, according to some embodiments of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

With respect to certain embodiments of the present disclosure, a methodology and system are provided to facilitate efficient testing of flows of well effluent or well treatment fluid to determine, for example, the constituents, e.g. phases, of the fluid. In, for example, well testing applications, the methodology and system provide a mobile, modular system which is easily and quickly adapted to the parameters, e.g. flow rates, of a given well. As described in greater detail below, the desired number of flow test modules may be combined into a modular flowmeter system, and that modular flow meter system may be rapidly adjusted to direct the flow of fluid being tested through a desired flow meter (or flow meters) without interchanging the flow meters. Instead of changing out flow meters over several hours, the modular system may be adjusted according to the parameters of a new well within a matter of minutes or even seconds, at least in some of the embodiments described herein. The modules or the overall modular flow meter system is mobile and easily transportable by, for example, standard over-the-road vehicles.

According to some embodiments, a modular flow meter system comprises a plurality of modules which each have a multiphase flow meter coupled into a flow circuit. The flow circuits of the plurality of modules are selectively connectable to each other via flow connectors. Additionally, portions of the flow circuits may be selectively opened and closed to enable controlled routing of the fluid being tested through the desired multiphase flow meter or meters. In some embodiments, the flow circuits may be selectively connectable via extensible flow connectors to facilitate a rapid joining of flow test modules into the overall modular flow meter system. Depending on the application, the multiphase flow meters of different modules may have different throat sizes, e.g. different Venturi throat diameters (and proportionally varied Venturi inlet diameters to maintain the same throat/inlet diameter ratio, e.g. 0.5), selected to accommodate different production fluid flows from the wells being tested. However, some embodiments may utilize two or more modules having multiphase flow meters with the same throat sizes to accommodate the same range of flow rates.

When performing mobile production testing of oil/gas wells using multiphase flow meters and where the flow rates are unknown, it can be useful to have flow meters with different sized Venturi throats. A conventional Venturi based multiphase flow meter may have a limited turn-down ratio of, for example, 10:1 in which the flow rate limit is dependent on the throat size. The modular flow meter system described herein, however, enables the selective use of at least two flow meters, e.g. multiphase flow meters, connected together with different throat sizes so as to substantially increase the turn-down ratio to ratios in the range of, for example, 50:1 through 100:1. If additional flow meters are added into the modular flow meter system, the turn-down ratio can be further increased.

According to some embodiments, the modular flow meter system may comprise a skid, e.g. a modular skid, onto which the mobile multiphase flow meter production test platforms are mounted. The modules of the modular flow meter system may each utilize an integrated bypass manifold for a more compact and lighter overall system. The bypass manifold may comprise a variety of flow circuits, as described in greater detail below, which enable selective isolation of specific flow meters, thus facilitating performance of fluid characterization measurements without having to interrupt the flow of production fluids. In a variety of applications, once the user has an understanding of the flow rates for specific wells to be tested, the modular construction enables separation of modules so that the separated flow meters may be used for different operations, hence increasing asset utilization.

Referring generally to FIG. 1, an example of a flow test module 30 is illustrated as comprising a flow meter 32, e.g. a multiphase flow meter, coupled into a flow circuit 34. By way of example, the flow meter 32 may comprise a Vx Spectra™ multiphase flow meter available from Schlumberger Technology Corporation for use in analyzing the flow rates and ratios of fluid constituents, such as oil, water, and gas in a produced well fluid. However, a variety of other types of flow meters 32 may be used in combination with flow circuit 34 depending on the parameters of a given fluid testing application. The flow circuit 34 comprises an inlet 36 through which the fluid to be tested, e.g. production well fluid, flows into the flow circuit 34. The flow circuit 34 also comprises an outlet 38 through which the fluid flow is discharged from the flow circuit 34. If the flow circuit 34 is configured to enable testing, the fluid is directed through flow meter 32 and is ultimately discharged through the outlet 38 of flow circuit 34.

However, module 30 is constructed so that flow through flow circuit 34 and flow meter 32 is easily controllable. In the embodiment illustrated, the flow of fluid along flow circuit 34 may be controlled via a plurality of isolation valves 40, 42 and 44. The valves 40, 42, 44 may be individually actuated between positions open to flow and closed to flow. For example, the flow of fluid entering inlet 36 may be directed through flow meter 32 by opening valves 40 and 44 while closing valve 42 located along a flow circuit bypass 46, e.g. a bypass manifold. However, the flow meter 32 is easily bypassed, for example, by closing valves 40, 44 while opening valve 42 in bypass 46. As described in greater detail below, the valves 40, 42, 44 may be used in combination with valves of corresponding modules 30 to direct desired flows of fluid through a specific flow meter 32. In the embodiment illustrated, valves 40, 42, 44 may be in the form of ball valves although other types of valves, e.g. sleeve valves, plug valves, other types of rotary valves, may be suitable for a variety of applications.

To facilitate coupling of module 30 with additional flow test modules 30, the flow circuit 34 comprises a plurality of flow connector ends 48. The flow connector ends 48 are disposed on flow conduits 50 of flow circuit 34 and are oriented for coupling with corresponding flow connector ends 48 of corresponding modules 30. When not in use, the flow connector ends 48 may be "blanked off" by securing blanks 52 to the flow connector ends 48 so as to prevent fluid flow therethrough. By way of example, the flow connector ends 48 may comprise flanges to which the blanks 52 are secured by suitable fasteners, e.g. threaded fasteners.

Depending on the application, flow circuit 34 may comprise a variety of other components or features. For example, the flow circuit 34 may comprise an access port 54 above flow meter 32 and a base sediment and water (BSW) port 56 below the flow meter 32. The flow circuit 34 also may comprise, for example, a liquid sampling port 58 and a gas sampling port 60. Various sensors, such as a pressure gauge 62, also may be positioned along flow circuit 34.

In some embodiments, the flow circuit 34 and flow meter 32 may be mounted on a portable skid 64. Skid 64 also may be modular for use with corresponding skids 64 of corresponding flow test modules 30. In some applications, the skids 64 of corresponding modules 30 may be coupled together to form an overall skid which facilitates movement of the module/modules 30 between locations, e.g. between well sites, to enable fluid testing procedures. The skids 64 are constructed to enhance the mobility and transportability of the modules 30 and may include features, such as forklift pockets 66 which facilitate lifting and movement of the skids 64 via forklift. In some applications, forklifts may be used to load and unload the modules 30 with respect to a suitable transport vehicle. Each skid 64 may comprise a variety of other features to facilitate aspects of given application. Examples of such features include drip pans 68 and grates 70.

Signals, e.g. informational data and/or control signals, may be communicated from and/or to flow meter 32 via a communication line or lines 72. For example, data on the phase composition of fluids flowing through multiphase flow meter 32 may be output through communication lines 72. Additionally, at least one of the communication lines 72 may be used to carry control signals to controllable isolation valves 40, 42, 44. In this manner, specific isolation valves 40, 42, 44 may be actuated to the desired open or closed position via an appropriate command/control signal. Depending on the type of isolation valve, the corresponding communication line 72 may be an electrical line, hydraulic line, or other suitable control line(s).

Figure 2:
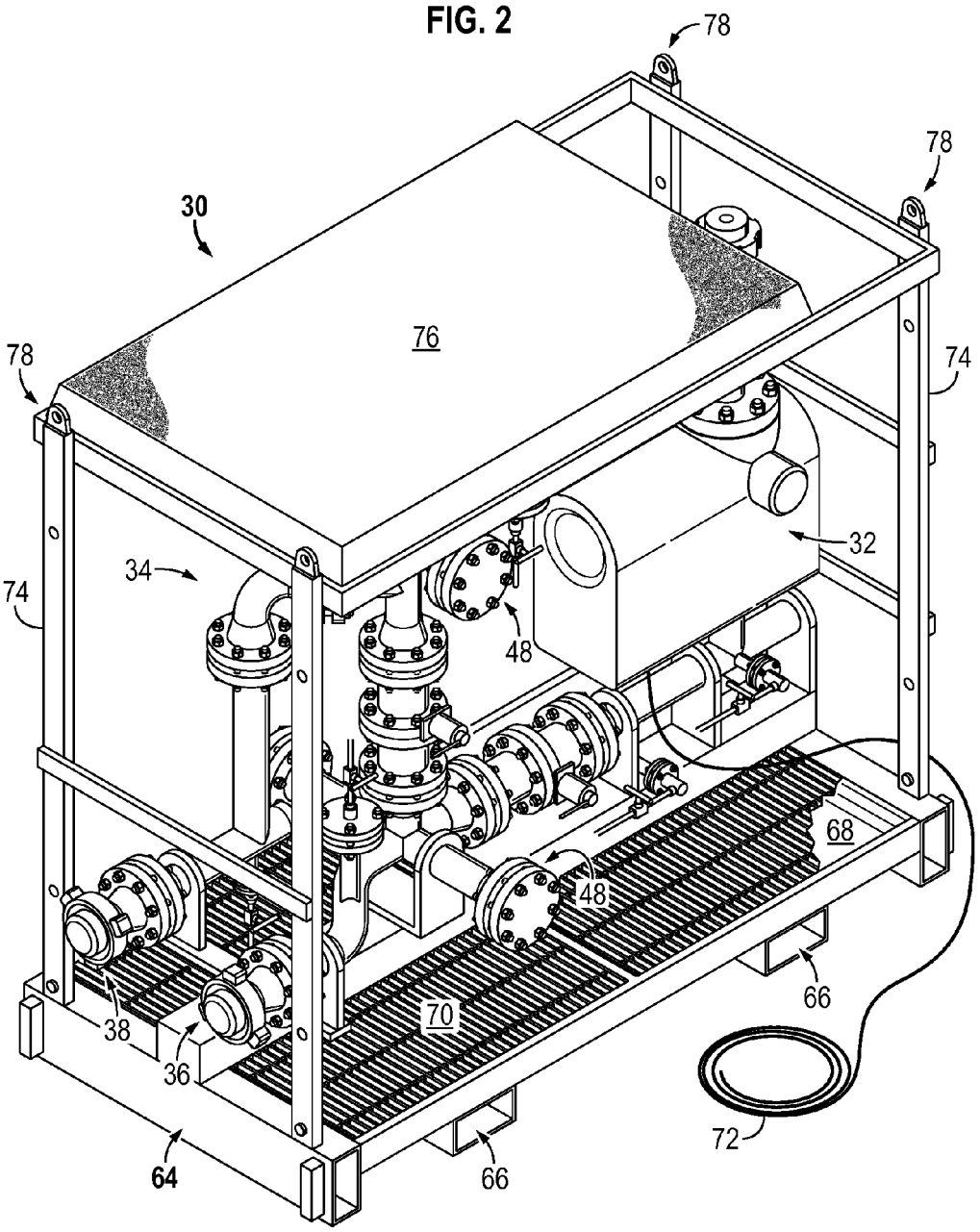
FIG. 2 is an illustration similar to that of FIG. 1 but with the addition of a protective framework and other features, according to some embodiments of the disclosure.

Referring generally to FIG. 2, another embodiment of module 30 is illustrated. In this example, a framework 74 is attached to skid 64. The framework 74 is constructed to surround flow circuit 34 and flow meter 32 and to provide protection during, for example, use and transport. In this example, the module 30 also may comprise various other features, such as a cover 76, e.g. a canvas cover, which may be selectively positioned to protect flow circuit 34 and flowmeter 32 from environmental elements. Lifting hooks 78 also may be attached to framework 74 to facilitate lifting and movement of module 30 via a crane or other hoist type mechanism.

Figure 3:
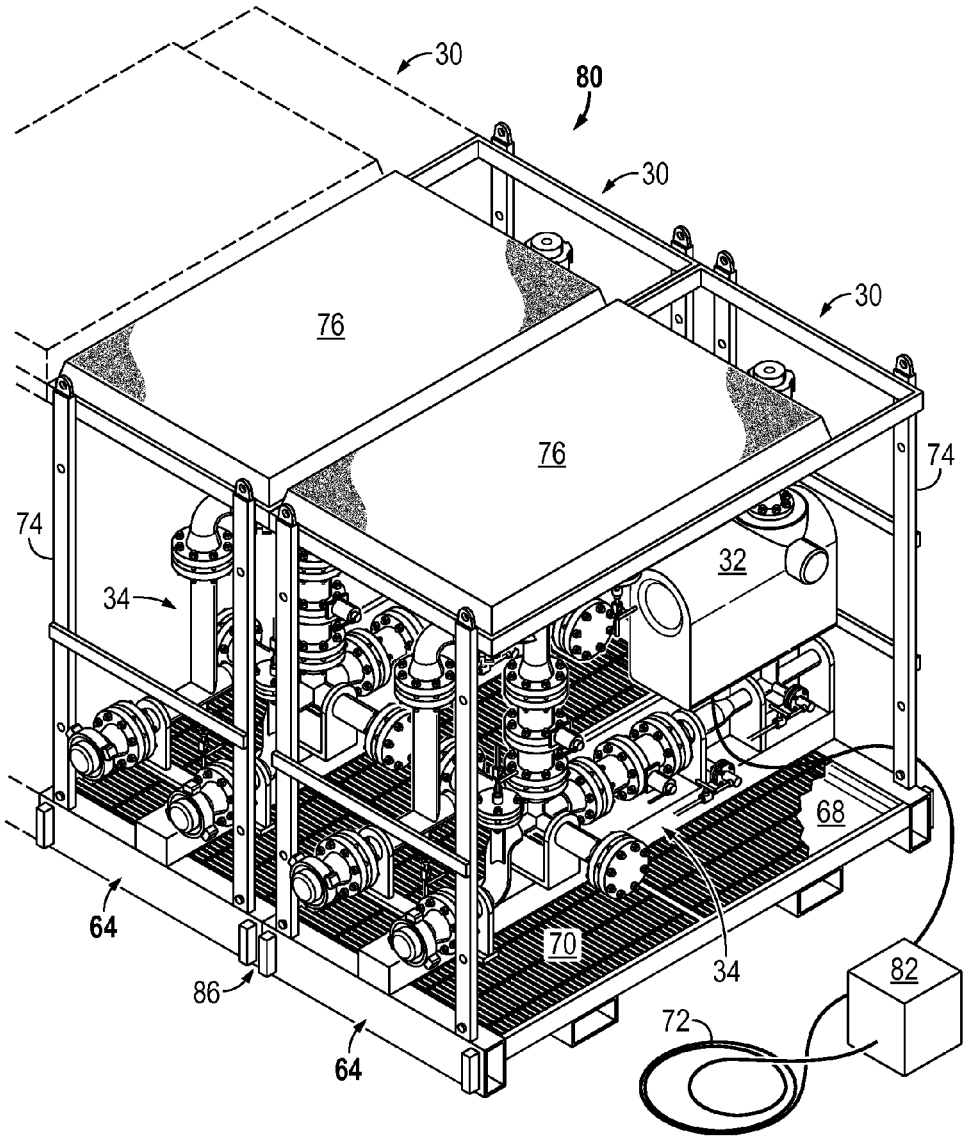
FIG. 3 is an illustration of a plurality of flow test modules coupled together into a modular flow meter system, according to some embodiments of the disclosure.
Figure 4:
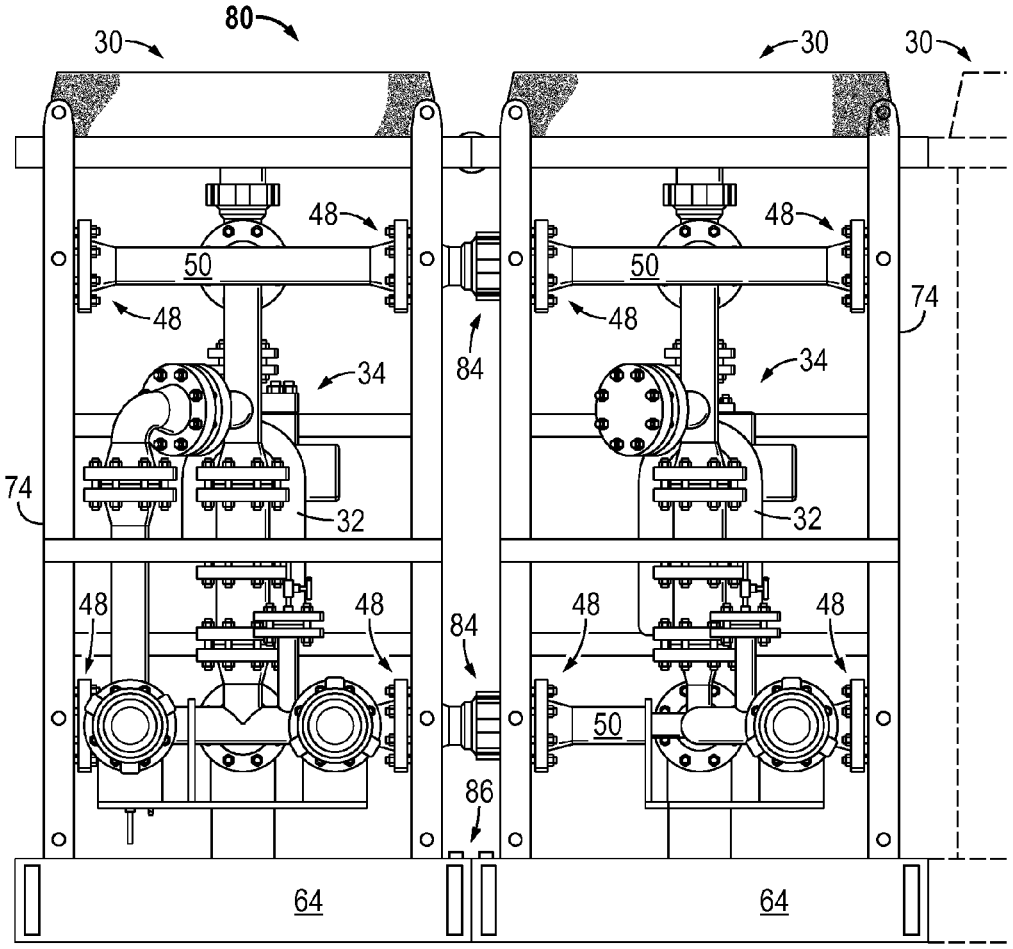
FIG. 4 is another view of the example of a modular flow meter system illustrated in FIG. 3, according to some embodiments of the disclosure.

Referring generally to FIGS. 3 and 4, an embodiment of an overall modular flow meter system 80 is illustrated. In this example, the modular flow meter system 80 is formed by combining the desired number of flow test modules 30 to configure the desired modular flow meter system 80. By way of example, the modular flow meter system 80 may be constructed by combining two modules 30. In some applications, the modular flow meter system 80 may be constructed by combining three or more of the flow test modules 30.

In various embodiments, the communication lines 72 from the plurality of modules 30 may be routed to a control system 82, such as a programmable, computer-based control system. However, other types of control systems 82 also may be utilized to, for example, receive data from the flow meters 32 and to provide control signals to the isolation valves 40, 42, 44. In some applications, control system 82 may be a programmable, processor-based system which is programmed to automatically actuate specific valves 40, 42, 44 of specific modules 30 so as to direct the flow of fluid, e.g. production well fluid, to the desired multiphase flow meter 32. It should be noted that in some applications, the flow of fluid may be directed to more than one flow meter 32.

By way of example, the control system 82 may be programmed to optimize utilization of the available flow meters 32 for a well having a given flow rate of production fluid. In such an application, each multiphase flow meter 32 utilizes, for example, a Venturi having a desired throat size. The control system 82 may be programmed to automatically select the flow meter 32 (or flow meters 32) having a flow-range rating which appropriately covers the range of actual fluid flow rates from the well. In some applications, manual selection of modules 30 and corresponding flow meters 32 also may be employed instead of the automated selection via control system 82. It should be noted modules 30 also may be used as stand-alone units if, for example, an operator is aware that a given well application will not have to utilize one of the modules 30. The "extra" module 30 can then be disconnected and utilized in a different application, thus maximizing asset utilization.

The corresponding, e.g. adjacent, modules 30 of modular flow meter system 80 may be coupled together by joining corresponding flow circuits 34 via flow connectors 84 (see FIG. 4). The flow connectors 84 may be connected between selected flow connector ends 48 of the corresponding, e.g. adjacent, flow circuits 34. The appropriate blanks 52 are simply removed from flow connector ends 48 so that corresponding flow connector ends 48 of corresponding modules 30 may be coupled together in fluid communication via the flow connectors 84. By way of example, the flow connectors 84 may be sealingly coupled to flow connector ends 48 of adjacent flow circuits 34 via flange-style connectors. In some applications, the adjacent skids 64 (and/or frameworks 74) also may be coupled together by a suitable connector 86 which may be in the form of bolts, other threaded fasteners, or other coupling mechanisms. As illustrated, the flow connector ends 48 which are not coupled together via flow connectors 84 remain closed via blanks 52.

Figure 5:
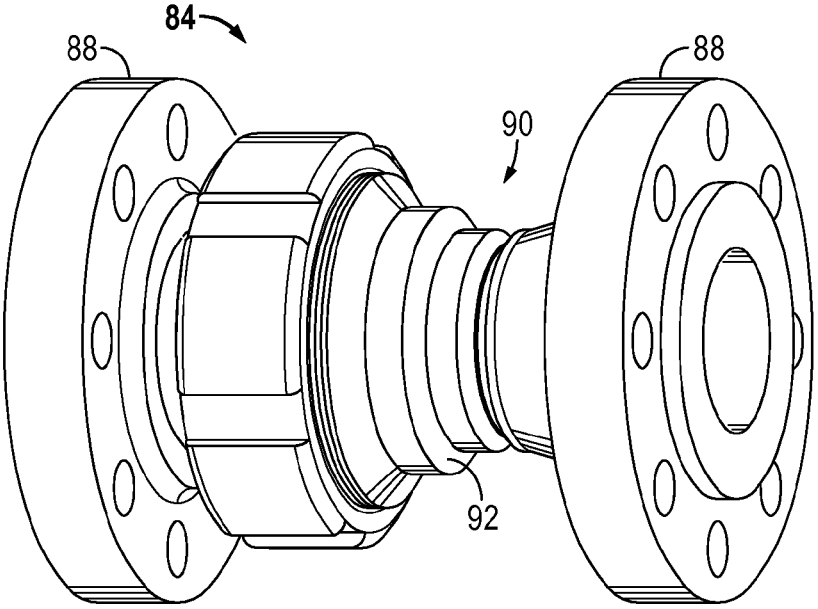
FIG. 5 is an orthogonal view of an example of an extensible connector which may be used to couple flow circuits of flow test modules, according to some embodiments of the disclosure.
Figure 6:
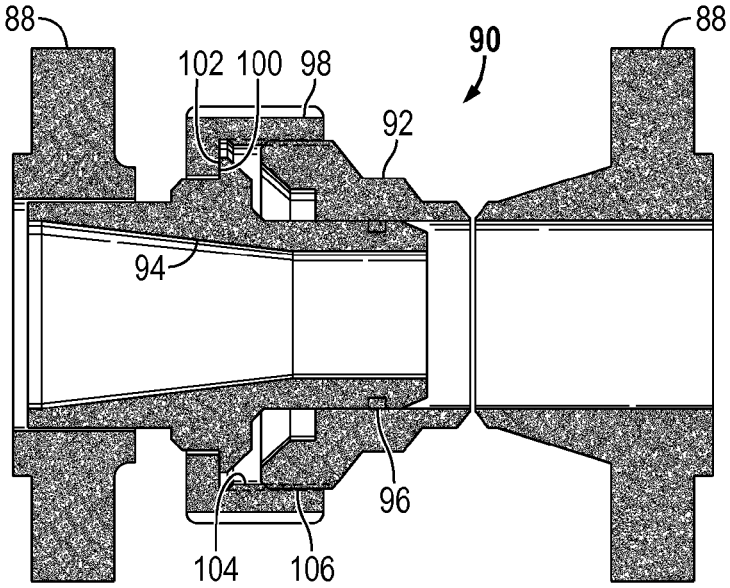
FIG. 6 is a cross-sectional view of the extensible connector illustrated in FIG. 5, according to some embodiments of the disclosure.

Referring generally to FIGS. 5 and 6, an embodiment of flow connector 84 is illustrated. In this example, the flow connector 84 is an extensible flow connector to facilitate coupling of corresponding flow circuits 34 of corresponding modules 30. Due to the tolerancing or positioning of adjacent flow circuits 34, the extendable nature of the illustrated flow connector 84 facilitates coupling of adjacent flow circuits 34. In this example, the flow connector 84 is linearly extensible although the flow connector can be constructed to accommodate other types of movement.

In the illustrated embodiment, flow connector 84 comprises a pair of flanges 88 constructed for coupling to corresponding flow connector ends 48 via a suitable threaded fasteners. The flanges 88 are coupled to telescopic piping 90 which allows linear movement of the flanges 88 with respect to each other. By way of example, the telescopic piping 90 may be constructed with a female union 92 slidably engaged with a male union 94 (see FIG. 6). The female union 92 and the male union 94 may be sealed with respect to each other via an internal seal 96.

Additionally, a threaded nut 98 may be used to secure female union 92 and male union 94 while also enabling linear adjustment of the distance between flanges 88. In the illustrated embodiment, threaded nut 98 comprises an abutment portion 100 which abuts against a corresponding abutment 102 of male union 94. The threaded nut 98 also comprises a threaded portion 104 which is threadably engaged with a corresponding threaded portion 106 of female union 92. By rotating threaded nut 98, female union 92 and male union 94 are forced to slide linearly with respect to each other along seal 96. Accordingly, the threaded nut 98 may be turned in one direction or the other to move flanges 98 closer together or farther apart, respectively. It should be noted that other components and component configurations may be utilized in providing an extensible or otherwise adjustable flow connector 84.

Depending on the application, various numbers of modules 30 may be coupled together to provide a desired number of flow meters 32 arranged in parallel. In many applications, when connecting the flow circuits 34, selected inlets 36 and outlets 38 may be blinded by, for example, blanks 52 to ensure the plurality of modules uses a single inlet 36 and a single outlet 38. The flow circuits 34 each effectively provide an integrated bypass manifold via flow circuit bypass 46 so that opening and closing of the desired valves 40, 42, 44 of selected modules 30 enables rapid diversion of the fluid flow to the desired flow meter 32 (or flow meters 32).

Figure 7:
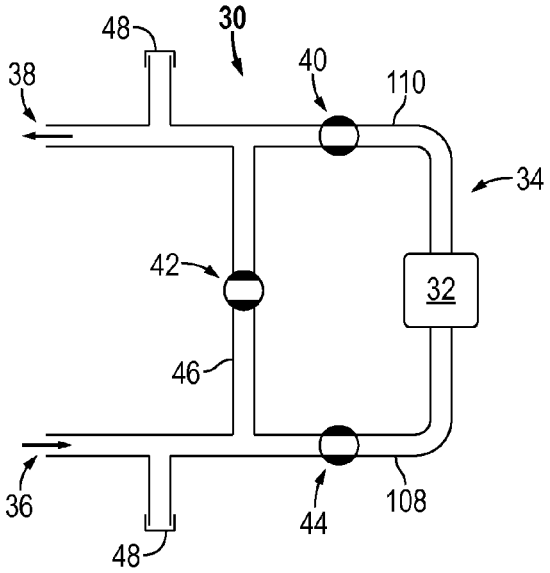
FIG. 7 is a flow diagram illustrating an example of a flow circuit of a flow test module, according to some embodiments of the disclosure.

Referring generally to FIG. 7, a flow diagram is provided and represents an example of flow circuit 34 of a single module 30. As illustrated, the flow circuit 34 comprises valves 40, 42, 44, e.g. remotely controllable ball valves, which control fluid flow with respect to the corresponding flow meter 32 of this particular module 30. In this example, valve 42 is again positioned in flow circuit bypass 46 while valve 44 is positioned along an inflow passage 108 and valve 40 is positioned along an outflow passage 110. Inflow passage 108 receives inflowing fluid from inlet 36 and outflow passage 110 delivers the flowing fluid to outlet 38 after passing through flow meter 32. Flow circuit bypass 46 extends between inflow passage 108 and outflow passage 110.

Figure 8:
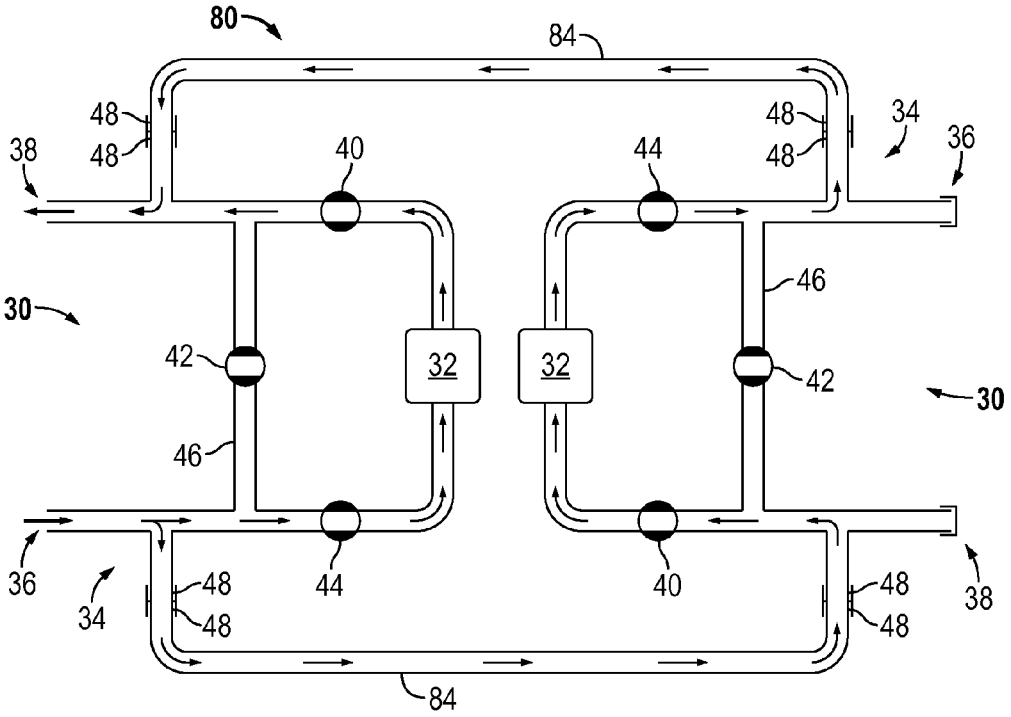
FIG. 8 is a flow diagram illustrating an example of a plurality of joined flow circuits of cooperating flow test modules in the overall modular flow meter system, according to some embodiments of the disclosure.

As illustrated in FIG. 8, a plurality of the flow circuits 34 may be coupled together. In the illustrated example, two flow circuits 34 are coupled together at corresponding flow connector ends 48 to form the overall modular flow meter system 80. Each flow circuit 34 is coupled with its corresponding flow meter 32 and comprises three isolation valves 40, 42, 44. In this particular example, the flow meter 32 of each module 30 has a different flow-range rating from the flow meter 32 of the other module 30. The different flow rates may result from each flow meter 32 having a different Venturi throat diameter size, while keeping the same Venturi throat/inlet diameter ratio, to accommodate different production fluid (or other fluid) flow rates. In this embodiment, the inlet 36 and outlet 38 associated with one of the flow circuits 34 are blanked off while the inlet 36 and outlet 38 associated with the other flow circuit 34 is used to accommodate the inflow and outflow of fluid being tested. Additional flow circuits 34 may be coupled into the overall modular flow meter system 80 as desired for a given application.

Figure 9:
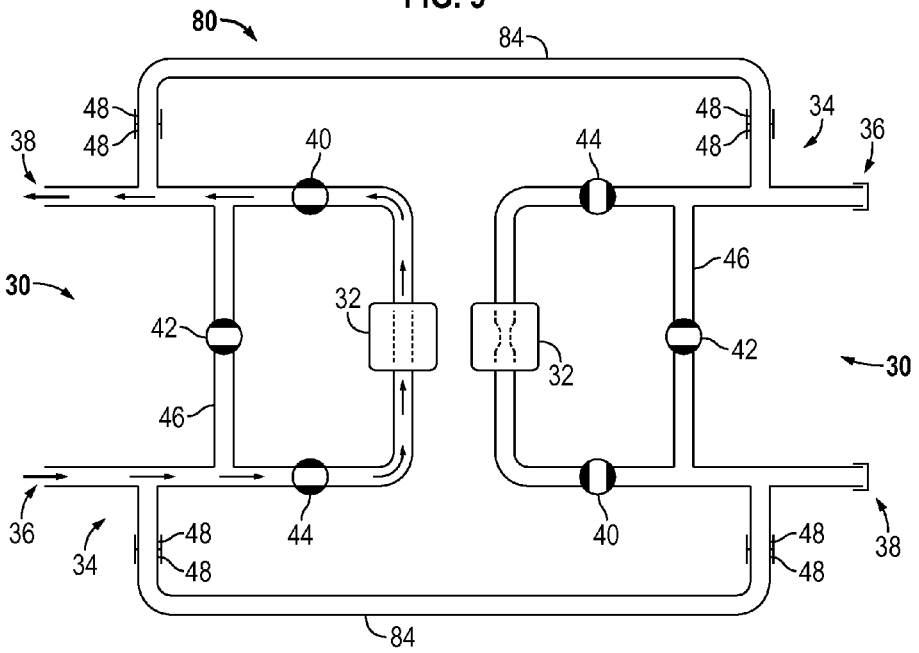
FIG. 9 is a flow diagram similar to that illustrated in FIG. 8 but in a different operational configuration, according to some embodiments of the disclosure.
Figure 10:
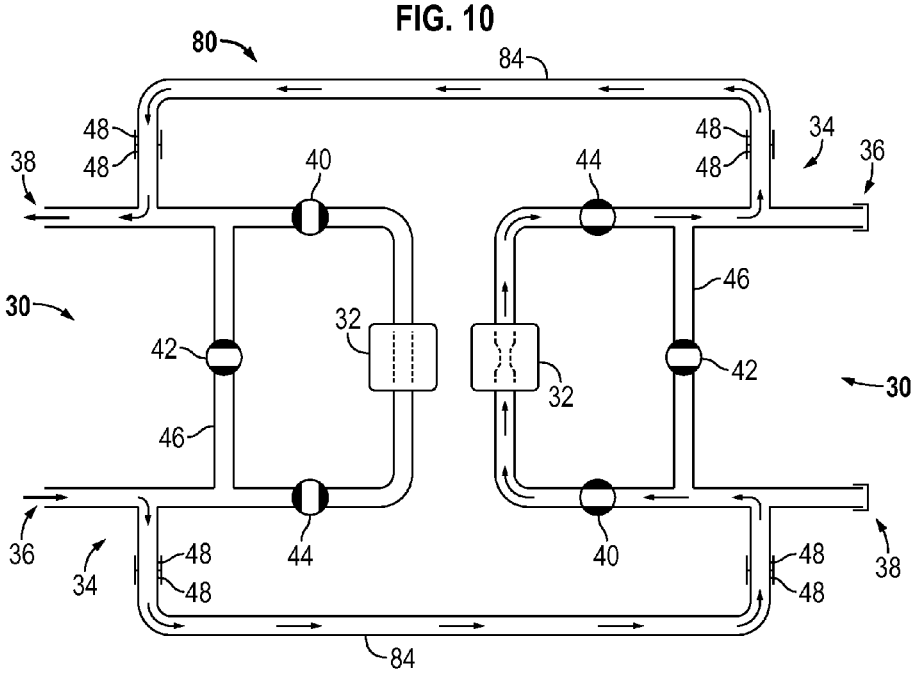
FIG. 10 is a flow diagram similar to that illustrated in FIG. 8 but in a different operational configuration, according to some embodiments of the disclosure.

In an operational example, the modular flow meter system 80 is used for well flow testing and is connected to a well. The flow of well fluid from the well is directed through the flow meter 32 having the larger throat size, i.e. larger flow-range rating, as illustrated in FIG. 9. In this example, the flow meter 32 on the left side of the diagram has the larger throat size, and the flow of well fluid is directed through this flow meter 32 by opening valves 40, 44 of the corresponding flow circuit 34 while closing all of the other valves as illustrated. By checking the measured differential pressure, a determination may be made as to whether the selected flow meter 32 is the proper flow meter or whether the flow should be diverted through the other flow meter 32 having a smaller throat size. By way of example, the differential pressure may be measured across the Venturi inlet and throat by a differential pressure sensor (not shown) that forms part of the flow meter 32. If a determination is made that the flow of well fluid should be directed through the other flow meter 32 (the flow meter on the right in this illustrated example), valves 40, 44 of the flow circuit 34 on the right are opened and all other valves are closed, as illustrated in FIG. 10.

Figure 11:
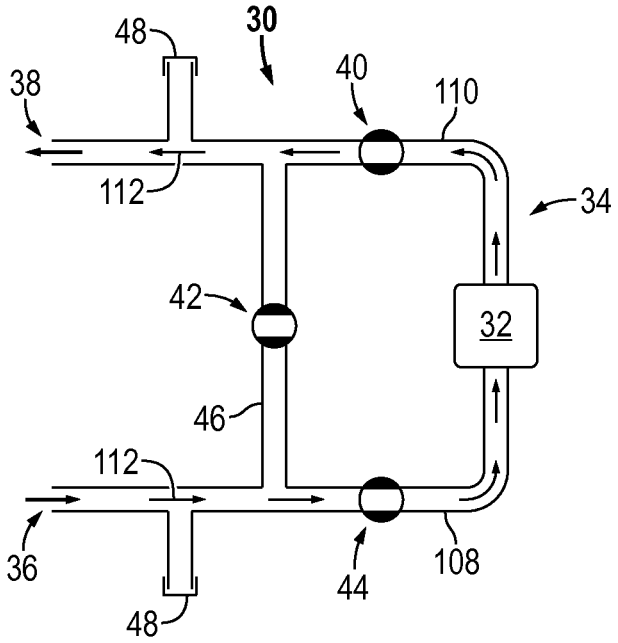
FIG. 11 is a flow diagram similar to that illustrated in FIG. 7 but in a different operational configuration, according to some embodiments of the disclosure.

As illustrated in FIG. 11, when a given flow meter 32 is selected and used, the bypass manifold 46 is closed off via closure of isolation valve 42. While isolation valve 42 is closed, valves 40, 44 are opened to ensure the fluid being tested is routed through the desired flow meter 32. As indicated by arrows 112, well fluid enters through inlet 36 and is blocked from moving through bypass 46. Accordingly, the flow of fluid is directed through isolation valve 44, through the appropriate flow meter 32, through isolation valve 40, and out through outlet 38.

Figure 12:
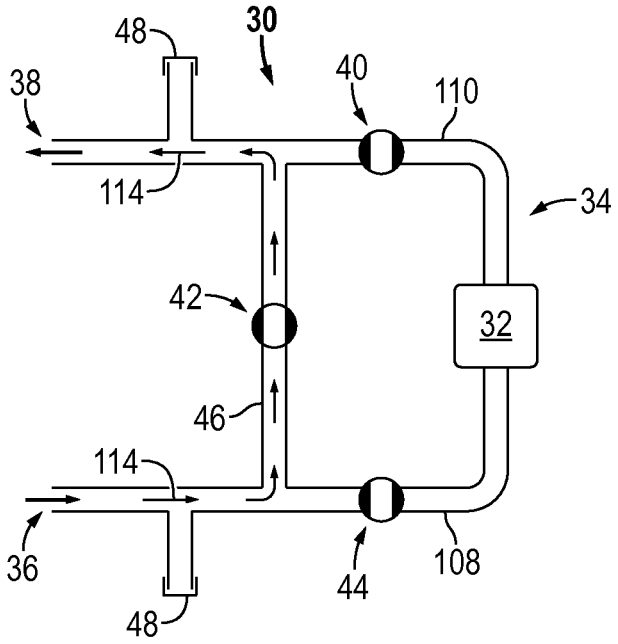
FIG. 12 is a flow diagram similar to that illustrated in FIG. 7 but in a different operational configuration, according to some embodiments of the disclosure.

When the subject flow meter 32 is to be isolated, however, the isolation valve 42 is opened and the isolation valves 40, 44 are closed, as illustrated in FIG. 12. The closure of isolation valves 40, 44 prevents flow of fluid through the flow meter 32 and effectively isolates the flow meter 32. The configuration of flow circuit 34 enables isolation of the flow meter 32 without interrupting the flow of fluid because the fluid can pass through bypass 46 and out through outlet 38, as indicated by arrows 114.

When the flow circuits 34 of corresponding flow test modules 30 are coupled together, various combinations of valves 40, 42, 44 may be opened or closed to direct the flow of fluid through desired flow meters 32 while isolating other flow meters 32 without interrupting flow. Accordingly, the configuration of flow circuit 34 in each module 30 along with the ability to easily combine a desired number of modules 30 provides great flexibility with respect to different testing operations. Additionally, the use of flow circuits 34 and isolation valves 40, 42, 44 enable easy and rapid selection of the desired flow meter 32 (or flow meters 32) for a specific fluid testing evaluation.

In well applications, the modular flow meter system 80 is readily constructed and transportable between well sites. The modularity of the system and the easily adjustable flow circuits 34 enable rapid selection of the appropriate multiphase flow meter 32 for evaluation of oil, water, gas phase mixtures of a well production fluid at each well site. In many applications, the system may utilize control system 82 to automate analysis of data from the desired flow meter(s) 32 and/or to automate actuation of valves 40, 42, 44 to enable selection of the optimal flow meter or meters 32 for a given testing operation.

It should be noted the methodologies and systems described herein may be used to determine the presence and phase fraction of a variety of desired constituents of various fluids. In many well applications, the constituents of interest are oil, water and gas. However, the embodiments described herein also may be used in a variety of other applications, including non-hydrocarbon fluid testing applications.

Additionally, each module 30 may comprise many types of components and may be constructed in various configurations. The overall modular flow meter system 80 similarly may comprise a variety of components in addition to modules 30. Various numbers of modules 30 also may be combined to accommodate the range of parameters of a given application. In many well applications, the flow meters 32 are multiphase flow meters, however other types of flow analysis meters also may be employed in each module 30. Additional and/or other types of sensors and evaluation tools may be integrated into each of the modules 30 to facilitate various fluid testing procedures.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

The invention claimed is:

1. A system for mobile testing of flows of fluid, comprising:

a modular flow meter system for testing flows of fluid, the modular flow meter system having a plurality of flow test modules releasably coupled to each other, each flow test module including:

a portable skid; and a flow circuit mounted on the portable skid, the flow circuit including:

a multiphase flow meter coupled into the flow circuit an inlet through which the flow of fluid enters the flow circuit;

an outlet through which the flow of fluid exits the flow circuit;

a plurality of isolation valves on the portable skid operable to selectively allow the flow through the multiphase flow meter to measure the fluid or prevent flow through the multiphase flow meter to at least redirect the flow, or prevent the flow from entering the flow circuit; and a plurality of flow connector ends by which the flow circuit may be coupled with at least one adjacent flow circuit of an adjacent flow test module.

2. The system as recited in claim 1, further comprising a plurality of adjustable connectors by which the flow connector ends of adjacent flow circuits are coupled to enable fluid flow between adjacent flow test modules.

3. The system as recited in claim 2, wherein each adjustable connector comprises telescopic piping.

4. The system as recited in claim 1, wherein the plurality of isolation valves comprises a plurality of ball valves.

5. The system as recited in claim 1, wherein the plurality of isolation valves comprises three isolation valves.

6. The system as recited in claim 1, wherein the modular flow meter system comprises at least two flow test modules.

7. The system as recited in claim 1, wherein the modular flow meter system comprises at least three flow test modules.

8. The system as recited in claim 1, wherein the multiphase flow meter of the flow test module has a different flow-range rating from the multiphase flow meter of the adjacent flow test module.

9. The system as recited in claim 1, wherein the multiphase flow meter of each flow test module has the same flow-range rating.

10. The system as recited in claim 1, wherein the modular flow meter system further comprises a control system coupled to the multiphase flow meter and the plurality of isolation valves of each flow test module to enable selective actuation of specific isolation valves.

11. A system, comprising:

a modular flow meter system transportable between well sites, the modular flow meter system comprising a plurality of flow test modules which each has a portable skid, and a multiphase flow meter and a flow circuit mounted on the portable skid, the flow circuit of corresponding flow test modules of the plurality of modules being selectively connectable via flow connectors, the flow circuits further comprising valves which may be actuated to allow flow through selected multiphase flow meters to measure fluid flow, prevent fluid flow through the selected multiphase flow meters to at least redirect the fluid flow, or prevent the fluid flow from entering one or more of the flow circuits.

12. The system as recited in claim 11, wherein the flow connectors are extensible to accommodate connection of adjacent flow test modules.

13. The system as recited in claim 12, wherein each flow connector comprises telescopic piping.

14. The system as recited in claim 11, further comprising a control system programmable to automatically control actuation of the valves.

15. The system as recited in claim 11, wherein each flow circuit comprises an inlet and an outlet, wherein at least one inlet and at least one outlet is blanked off to ensure a single inlet and a single outlet is to receive and discharge fluid with respect to the plurality of flow test modules.

16. The system as recited in claim 11, wherein each one of the plurality of modules is portable via forklift pockets.

17. The system as recited in claim 11, wherein the valves comprise ball valves selectively actuated via a control system.

18. A method, comprising:

preparing a plurality of flow test modules such that each flow test module includes a portable skid, a flow circuit mounted on the portable skid, the flow circuit including a flow meter, and a plurality of isolation valves on the portable skid;

combining a desired number of flow test modules to create a mobile, modular flowmeter system;

joining the flow circuits of the desired number of flow test modules; and adjusting at least one of the flow circuits to change a flow route and to direct a flow of fluid through at least one of the flow meters for analysis, or redirect the flow route to prevent the flow from entering at least one of the flow meters.

19. The method as recited in claim 18, wherein joining comprises joining the flow circuits with extensible flow connectors.

20. The method as recited in claim 18, wherein adjusting comprises actuating one or more of the isolation valves via a control system.

* * * * *